US008723778B2

(12) United States Patent
De Greef

(10) Patent No.: US 8,723,778 B2
(45) Date of Patent: May 13, 2014

(54) OVERDRIVE TECHNIQUE FOR DISPLAY DRIVERS

(75) Inventor: Petrus Maria De Greef, Eindhoven (NL)

(73) Assignee: NXP B.V., Eindhoven (NL)

( * ) Notice: Subject to any disclaimer, the term of this patent is extended or adjusted under 35 U.S.C. 154(b) by 1531 days.

(21) Appl. No.: 11/576,684

(22) PCT Filed: Sep. 27, 2005

(86) PCT No.: PCT/IB2005/053190

§ 371 (c)(1),
(2), (4) Date: Feb. 6, 2008

(87) PCT Pub. No.: WO2006/038158

PCT Pub. Date: Apr. 13, 2006

(65) Prior Publication Data

US 2008/0259059 A1 Oct. 23, 2008

(30) Foreign Application Priority Data

Oct. 4, 2004 (EP) ..... 04104854

(51) Int. Cl.
*G09G 3/36* (2006.01)

(52) U.S. Cl.
USPC ..... 345/100

(58) Field of Classification Search
USPC ..... 345/84–104
See application file for complete search history.

(56) References Cited

U.S. PATENT DOCUMENTS

| | | | | |
|---|---|---|---|---|
| 5,953,074 | A * | 9/1999 | Reddy | 348/558 |
| 6,025,822 | A * | 2/2000 | Motegi et al. | 345/98 |
| 6,456,340 | B1 * | 9/2002 | Margulis | 348/745 |
| 6,489,964 | B1 * | 12/2002 | Van Asma | 345/545 |
| 6,989,825 | B2 * | 1/2006 | Naito et al. | 345/204 |
| 7,109,974 | B2 * | 9/2006 | Kempisty | 345/173 |
| 7,696,988 | B2 * | 4/2010 | Wu et al. | 345/204 |
| 2002/0175907 | A1 | 11/2002 | Sekiya et al. | |
| 2003/0137527 | A1 | 7/2003 | Lin et al. | |
| 2003/0156092 | A1 | 8/2003 | Suzuki et al. | |
| 2004/0041745 | A1 | 3/2004 | Chen | |
| 2005/0068343 | A1 * | 3/2005 | Pan et al. | 345/690 |

FOREIGN PATENT DOCUMENTS

| | | | |
|---|---|---|---|
| CN | 1428755 | A | 7/2003 |
| CN | 1476239 | A | 2/2004 |

OTHER PUBLICATIONS

Wubben, R., et al, "LCD Overdrive Frame Memory Reduction Using Scalable DCT-Based Compression" 2004 SID Int'l. Symposium Digest of Technical Papers, vol. 35, pt. 2, pp. 1348-1351 (2004).

* cited by examiner

*Primary Examiner* — Joe H Cheng
*Assistant Examiner* — Steven Holton

(57) ABSTRACT

The invention relates to a display driver comprising an embedded frame memory and an overdrive logic block for moderating display data of a current frame received by the display driver by means of overdrive. The overdrive logic block is arranged for reading data from and writing data to the embedded frame memory and for using display data of a previous image stored in the embedded frame memory for calculating overdrive display data of the current frame. The overdrive display data is used for refreshing the image depicted on a display device. The invention further relates to an LCD display device comprising such a display device.

16 Claims, 12 Drawing Sheets

OVERDRIVE TECHNIQUE FOR DISPLAY DRIVERS

FIELD OF INVENTION

This invention relates to a display driver, and an LCD display device comprising such a display driver.

BACKGROUND AND SUMMARY OF THE INVENTION

LCD display devices in monitors, TVs, computers, mobile devices, wireless devices and so on typically have a relatively slow response time while switching a pixel from a grey level to another grey level. Generally, moving images have disturbed appearances leading to motion portrayal artifacts on the LCD display devices. The image needs to be rendered properly on the LCD display device in order to reduce such artifacts.

The slow response time of the LCD display devices is caused by the fact that, upon a frame change, it takes a couple of frame-times before a pixel reaches its intended transmission value due to the inherent slowness of the liquid crystal materials.

It is known that some LCD display drivers implement an overdrive technique. US20030156092 describes the implementation of such an overdrive technique. In this document a display driver hosting a frame memory as well as an operational unit controlling the display device is disclosed. The scope of this invention is in implementing overdrive.

Overdrive is a technique for writing a display data signal that is temporarily more emphasized than the display data signal corresponding to actual pixel transmission of the LCD display device. Due to this technique, the liquid crystal cell of the LCD display device reaches the intended transmission much faster. The overdrive technique thus improves the display performance of moving images on LCD display devices as it enhances the pixel response time.

This overdrive technique works by representing an incoming display data signal as a pixel drive voltage, which is greater than the required voltage of that pixel for better transmission. Similarly, whenever the pixel transmission needs to be decreased a lower pixel voltage is supplied.

This technique uses information of the display data signal of the previous frame, the display data signal of the current frame and an overdrive lookup table to calculate the corrected signal for overdrive. The signal that is overdrive corrected is then transmitted to the pixels of the LCD display device to display the corresponding image for the incoming display data.

The problem with the techniques discussed in the prior art is that refreshing the display data on the LCD display device requires a large frame-memory and leads to relatively high power consumption.

It is an object of the present invention to provide improved motion portrayal in particular to LCD display devices with relatively low power consumption.

The display driver according to the invention as specified in claim 1 has achieved this object. The driver comprises an embedded frame memory and an overdrive logic block, for moderating display data of a current frame received by the display driver by means of overdrive, wherein the overdrive logic block is arranged for reading data from and writing data to the embedded frame memory, and for using display data of a previous frame stored in the embedded frame memory for calculating overdrive display data of the current frame.

The embedded frame memory and the overdrive logic block are hosted within the display driver to achieve overdrive with no additional hardware. The overdrive logic block is used for reading data from and writing data to the embedded frame memory and also performs the calculations related of the pixel drive voltages that need overdrive. The display data of the previous frame is used by the overdrive logic block for calculating the overdrive correction to be applied to the incoming display data of the current frame. This mode of operation is referred to hereinafter as the indirect display mode or the internal timing mode.

A further embodiment is characterized in that the overdrive display data is calculated on alternating frames.

In a further embodiment overdrive correction factors are stored in an overdrive lookup table and are used for calculating the overdrive display data.

The said overdrive lookup table may be implemented using a read-only-memory (ROM), an electrically erasable programmable read-only-memory (EEPROM) or any other storage devices having a similar function. The overdrive logic block uses the overdrive lookup table to obtain the correction factor to be applied to the incoming display data signal of the current frame. These overdrive display data is thus preferably calculated from the overdrive display data of the previous frame stored in the memory, the incoming display data of the current frame, and an appropriate overdrive correction factor obtained from the lookup table.

Another preferred embodiment is characterized in that the embedded frame memory stores the overdrive display data for at least part of the current frame.

Overdrive must act on images and not on frames. Generally, in mobile devices the image refresh rate is very low. Therefore, in mobile applications frame rate up-conversion is often applied, by duplicating image data, leading to multiple frames containing the same image data.

A further embodiment of the invention is characterized in that the driver is further being arranged to operate in a frame rate up-conversion mode, wherein the embedded frame memory is used as a frame store for repeating the display data. Preferably frame rate up-conversion operates on static images.

Preferably, the driver operates in the frame rate up-conversion mode when the incoming display data comprises mainly static images such as background images and menus.

The driver can also be set to operate in a direct display mode when the incoming display data comprises mainly full screen moving images such as a video clip. In the direct display mode the embedded frame memory no longer stores the display data being displayed on the LCD panel, instead it may have different functions. An external control unit generates timing signals for controlling direct transmission of the display data to the LCD panel.

In a further preferred embodiment of the direct display mode, the embedded frame memory is a frame-delay FIFO for overdrive correction of the display data.

Yet another further embodiment is that the overdrive display data is calculated at least for a part of the display area representing a video window with moving images.

The advantage of storing part of a frame in the embedded frame memory is that only the video window needs to be refreshed in every frame, a static part of the frame is kept in the memory and can be refreshed less often. The embedded frame memory does store an entire frame however the image data for the video window is used for overdrive correction of the next image in the video window.

A further embodiment is that the driver is further being arranged to operate in an overlay mode, wherein the embedded frame memory is a frame overlay for mixing display data.

The overlay data is stored in the embedded frame memory. The overlay data such as a phone menu, is fetched from embedded frame memory and mixed with background display data, using a multiplexer or mixer, and displayed on the LCD panel. The multiplexer outputs both the background and incoming display data on the LCD panel, preferably in a predetermined ratio in the direct display mode.

In a further embodiment the driver comprises means for switching between different operational modes, such as the direct display mode with overdrive, overlay mode, the indirect display mode and frame-rate up-conversion mode.

Another preferred embodiment is characterized in that the overdrive display data enhances the response time of an LCD panel.

The overdrive pixel voltage enhances the voltage supplied to the pixels of an LCD display panel in order to speed up a change in the optical transmission of the pixels to be displayed on the LCD display device. The advantage of this is that the response time of the LCD display device is enhanced.

Another aspect of the invention is a LCD display device comprising a display driver as described in the above. Achieving overdrive and improving motion portrayal by the display driver in accordance with the invention improves efficiency of the LCD display device with little additional hardware and lesser power consumption.

DESCRIPTION OF THE DRAWINGS

Aspects of the present invention will become apparent from and will be elucidated with respect to the embodiments described hereinafter with reference to the accompanying drawings. The drawings illustrate the embodiments of the invention and together with the description, serve to explain the principles of the invention. In the drawings.

DETAILED DESCRIPTION

LCD display devices that have overdrive generally incorporate the principle that when a pixel of the LCD panel is driven from one gray level to another gray level in one frame (time) period, the voltage required to drive it, called the pixel drive voltage representing the incoming display data for said pixel, enhances the response time of the LCD display panel. In the next frame period the actual voltage corresponding to the desired pixel transmission is applied. The change in gray level of a specific pixel can be calculated by subtracting the previous pixel value from the current pixel value. This value is then used to determine a correction value using the overdrive look-up table and adapts the pixel voltage accordingly. The overdrive value for the pixel for the incoming display data can be calculated using, $$V''_{(pixel_n)}=V_{(pixel_n)}+C_f(V_{(pixel_n)}-V_{(pixel_n-1)})) \quad (1)$$

where $V''_{(pixel_n)}$ represents the calculated overdrive value for a given pixel, $V_{(pixel_n)}$ represents the actual pixel voltage corresponding to the desired transmission for the pixel, $C_f$ represents a correction factor and $(V_{(pixel_n)}-V_{(pixel_(n-1))})$ represents the difference between the intended pixel value and the pixel value of the previous frame.

Liquid crystal materials that have a relatively quick response may cause some flickering effect or trailing wave effect when the eye tracks the moving edges of an image on the LCD panel. Reference to this will be made later in the description.

When applying overdrive, the voltage across the liquid crystal pixel is increased beyond the level corresponding to the desired pixel transmission and enhances the response time of the LCD display device. However, it is important to note that the physical characteristics of the LCD panel do not change in the process.

Figure 1A:
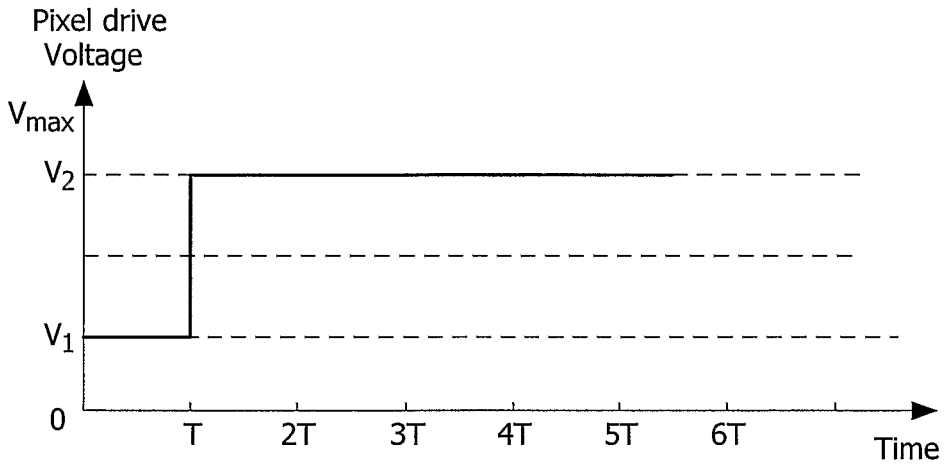
FIG. 1*a* schematically shows a pixel drive voltage without any overdrive being applied.

FIG. 1*a* is a schematic representation of the pixel drive voltage on the Y-axis and time on the X-axis. The schematic representation shown is well known in the prior art with systems where there is no overdrive applied to the incoming display data signal. The incoming signal is directly fed to the pixel on the LCD panel without any overdrive. The incoming display data takes the form of a pixel drive voltage that can vary anywhere between 0 to $V_{max}$ Volts. The voltage level 0 Volts could for example correspond to a black pixel having no optical transmission and the voltage $V_{max}$ volts could represent a white pixel having maximum optical transmission.

Figure 1B:
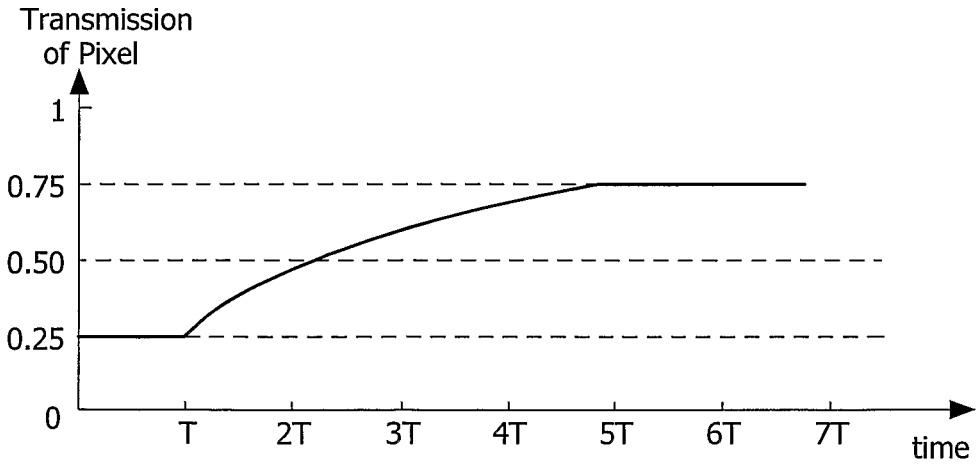
FIG. 1*b* schematically shows the transmission of the pixel from one grey level to another grey level in response to the pixel drive voltage characteristic of FIG. 1*a;*

In FIG. 1*a*, the pixel drive voltage representing the incoming display data signal, changes at a given instant of time T. At time t=0, the pixel voltage drive is $V_1$ Volts. After one frame period, at a time T, the pixel drive voltage changes from $V_1$ Volts to $V_2$ Volts. This change in the pixel drive voltage has a direct correspondence with the transmission to the pixel of the LCD display device as shown in FIG. 1*b*. In FIG. 1*b*, the X-axis represents time and the Y-axis represents the optical transmission of the pixel.

When the Voltage in FIG. 1*a* is 0 Volts, the transmission to the pixel in FIG. 1*b* is also 0, corresponding to no optical transmission to the pixel and therefore the pixel is black. When the pixel drive voltage is $V_{max}$ Volts in FIG. 1*a*, the corresponding pixel transmission is almost 100%, represented as a optical transmission of 1 in FIG. 1*b*, there is complete optical transmission and the pixel is white.

A pixel drive voltage of $V_1$ Volts represents 25% optical transmission as shown in FIG. 1*b*. At the time period T, the pixel drive voltage changes from $V_1$ Volts to $V_2$ Volts, and the corresponding optical transmission for the pixel changes from 25% to 75%. While the pixel drive voltage is able to change sharply as shown in FIG. 1*a*, from $V_1$ Volts to $V_2$ Volts, the corresponding pixel transmission response is relatively slow, for example as shown in FIG. 1*b*, it takes a much longer time to reach the intended transmission value, for example in this case about 5 frame periods. This could result in motion artifacts, for example the trailing wave effect, being displayed on the LCD display device.

Figure 2A:
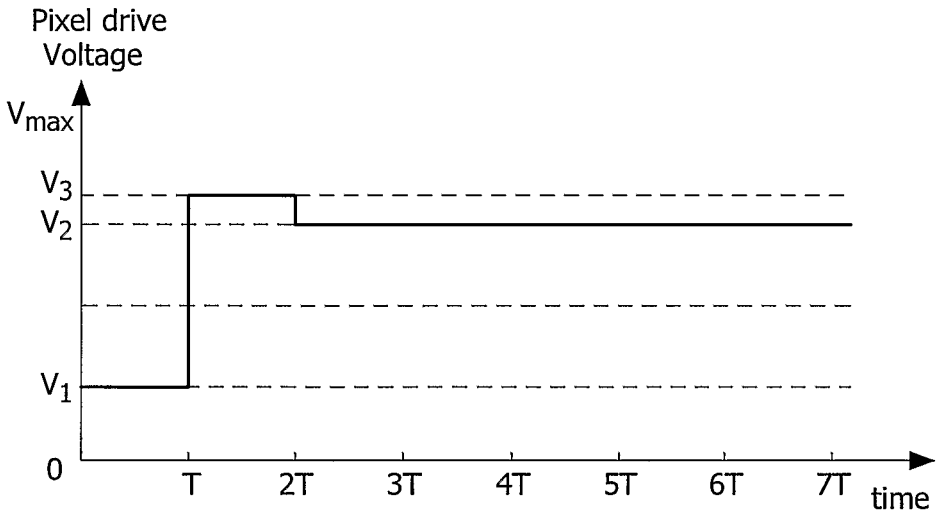
FIG. 2*a* shows a pixel drive voltage with an overdrive being applied.
Figure 2B:
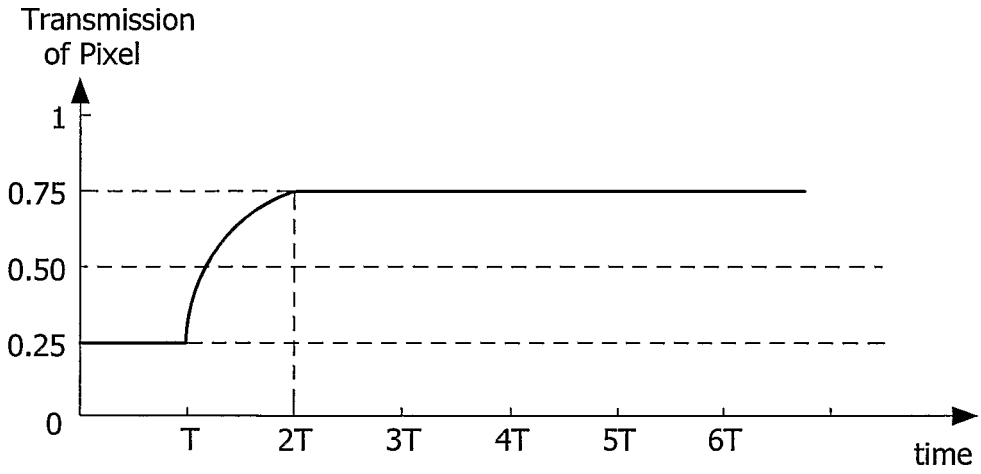
FIG. 2*b* schematically shows the corresponding transmission of the pixel in response to the pixel drive voltage characteristic of FIG. 2*a;*

FIG. 2*a* schematically shows the pixel voltage drive on the Y-axis and the corresponding time periods on the X-axis for an overdrive system. At a time period T, the pixel drive voltage is overdriven to a voltage of $V_3$ volts, which is less than $V_{max}$. In the next time periods the pixel drive voltage stabilizes at $V_2$ Volts. The corresponding optical transmission for the pixels is shown in FIG. 2*b*. It can be seen that the pixel transmission from 25% to the intended transmission of 75% is achieved faster. From Equation (1), at time period t=T, $V_{(pixel_n)}=V(T)=V_2$ and $V_{(pixel_(n-1))}=V(0)=V_1$. Therefore, from Equation (1) it follows that $V''_{(pixel_n)}=V_3$. In the next time period when t=2T, $V_{(pixel_n)}=V(2T)=V_2$ and $V_{(pixel_(n-1))}=V(T)=V_2$. Further from Equation (1) it follows that $V''_{(pixel_n)}=V_2$. Therefore, when the pixel drive voltage is the same as in the previous frame then $V''_{(pixel_n)}$ is the same as $V_{(pixel_(n-1))}$ and no overdrive correction is applied. This can be seen in FIG. 2*a*, in that the pixel drive voltage stabilizes at $V_2$ volts.

The calculation for the overdrive correction according to the invention can be represented by the formula $$V''_{(pixel_n)}=V_{(pixel_n)}+C_f^*(V_{(pixel_n)}-V''_{(pixel_(n-1))}) \quad (2)$$

where $V''_{(pixel_(n-1))}$ represents the compensated pixel voltage of the previous frame stored in the embedded frame memory and $C_f^*$ is the correction factor. The other symbols in Equation (2) are the same as those defined in Equation (1). An important advantage of the present overdrive technique is that it involves no additional frame memory for processing, thus saving power consumption by the device.

Figure 3:
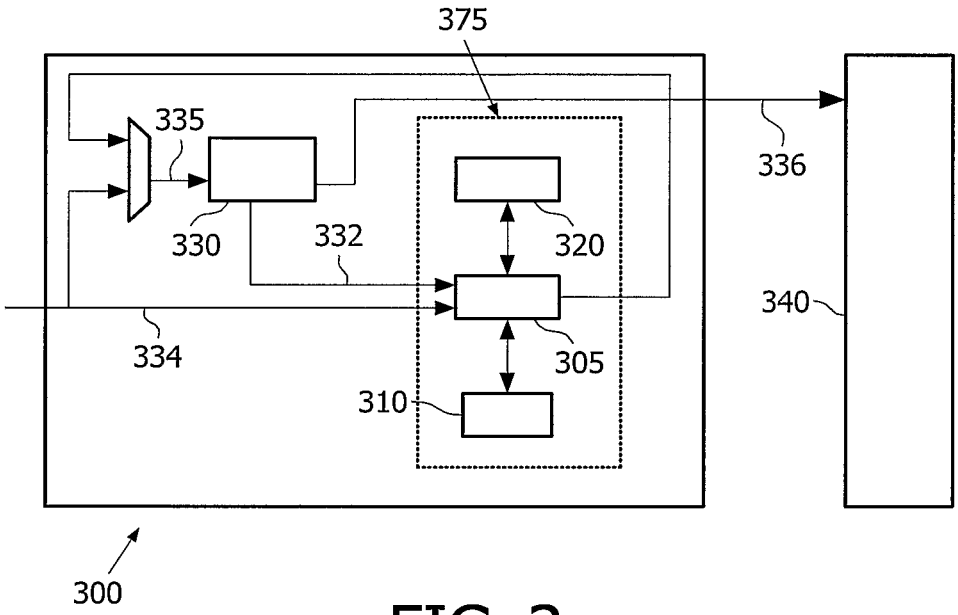
FIG. 3 schematically shows an embodiment of the display driver for operating in the indirect display mode according to the invention.

The algorithms described above can be implemented within the display driver that encompasses the embedded frame memory. FIG. 3, gives a schematic overview of an embodiment of the display driver 300 for an LCD display panel 340, for operating in the internal timing mode. The display driver 300 comprises the overdrive logic block 305, the overdrive lookup table 310, the control block 320 and the embedded frame memory 330. The usual practice is to insert, in a dedicated time slot within the frame, a non-information bit that is used for the actual synchronization of the incoming display data 334, i.e. frame synchronization. The incoming display data signal 334 is overdrive corrected before it is displayed on the LCD panel 340. The system comprises an overdrive logic block 305 that is used to calculate the overdrive values for the incoming display data signal 334. The overdrive lookup table 310 is used to store the correction factors that are used to overdrive the incoming display data. Further, display driver 300 also comprises a control logic block 320 that is essentially used to control the overdrive technique and the timing mode.

The overdrive logic block 305, the overdrive lookup table 310 and the control block 320 can be combined into one block 375 in a preferred embodiment. This preferred embodiment however, does not restrict that each of the above mentioned blocks exist as separate units within the display driver 300. An incoming display data signal 334 for the requested initial frame data enters the overdrive logic block 305, is processed for overdrive corrections, preferably by use of the overdrive lookup table 310. The overdrive corrected frame 335 is then stored in the embedded frame memory 330, before being sent as the frame 336 to be displayed on the LCD panel 340.

Figure 4A:
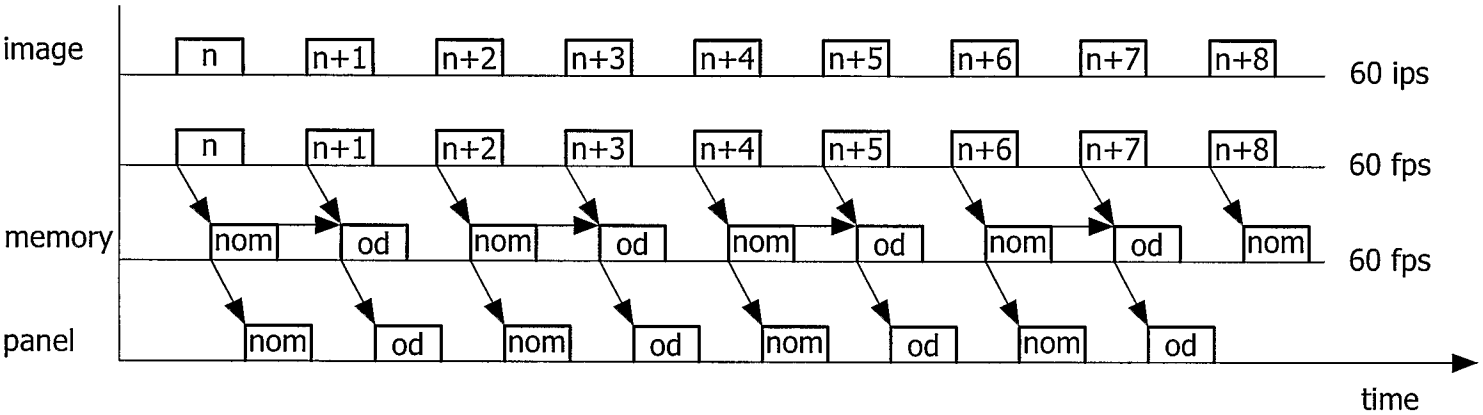
FIGS. 4*a*-4*d* schematically show different indirect display operational modes.

FIG. 4*a* schematically illustrates an internal timing mode of the driver, where overdrive display data is calculated on alternating frames. "od" represents a frame that is overdrive corrected. The nominal uncorrected image 'nom' of the image data 'n' in the embedded frame memory 330 is used to perform overdrive correction on the next image 'n+1'. The initial image 'n' is not overdrive corrected and is stored as a nominal image "nom" in the embedded frame memory 330. The nominal image is sent to the LCD panel 340 from the embedded frame memory 330. The next image 'n+1' is overdrive corrected using the image data of the previous image 'n' stored in the embedded frame memory 330. The overdrive corrected data is subsequently stored in the embedded frame memory 530 before being sent to the LCD panel 540 to be displayed. The next image 'n+2' is not overdrive corrected and is again stored as a nominal frame 'nom'. Subsequently, it is retrieved by the overdrive logic block 305 to overdrive correct the next incoming image data 'n+3'.

As a result, the even frames are not processed and the odd frames are overdrive corrected and overdrive is applied on alternate frames. The image data of the nominal frame 'nom' of an even frame is stored in the embedded frame memory 330 and is used to perform overdrive correction on the odd frame 'n+1', 'n+3' and so on.

Figure 4B:
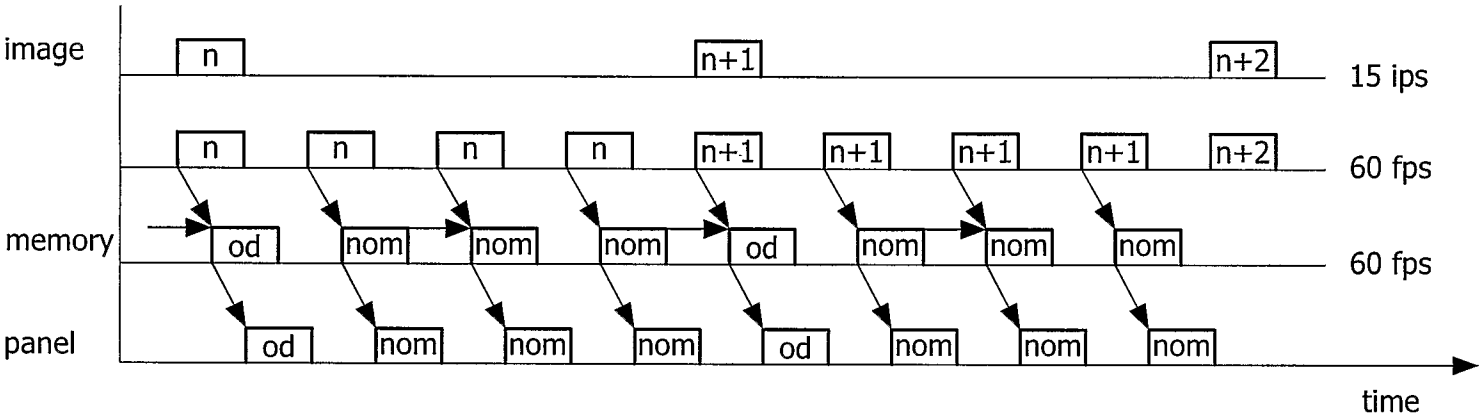

FIG. 4*b* represents overdrive correction being applied in alternating frames. In this case, the incoming image rate is low, for example at 15 images per second. Then the image data needs to be frame rate up-converted before being displayed on the LCD panel 340. In this case frame rate up-conversion is done externally. The first and the third of the frame of each image data are overdrive corrected. Though the third frame is overdrive corrected, it still represents nominal image data in the embedded frame memory 330 as the overdrive correction applied in this case is zero as can be deduced from $V''_{(pixel_n)}=V_2+C_f^*(V_{(pixel_n)}-V''_{(pixel_n)})=V_2+C_f^*(0)=V_{(pixel_n)}$. Hence, the first frame is overdrive corrected and the next three frames for an image data resulting from the frame rate up-conversion are sent to the embedded frame memory 330 without any overdrive correction. Therefore, overdrive is applied in alternate frames but in an incomplete manner, as overdrive is being applied only in the first frame of each image 'n', 'n+1' etc. of the incoming display data. The last frame of the image data for 'n' is used to overdrive correct the incoming display data signal of the following image 'n+1'. It proceeds in the same manner for subsequent frames. This mode is preferable when the incoming image has a relatively low image rate.

Figure 4C:
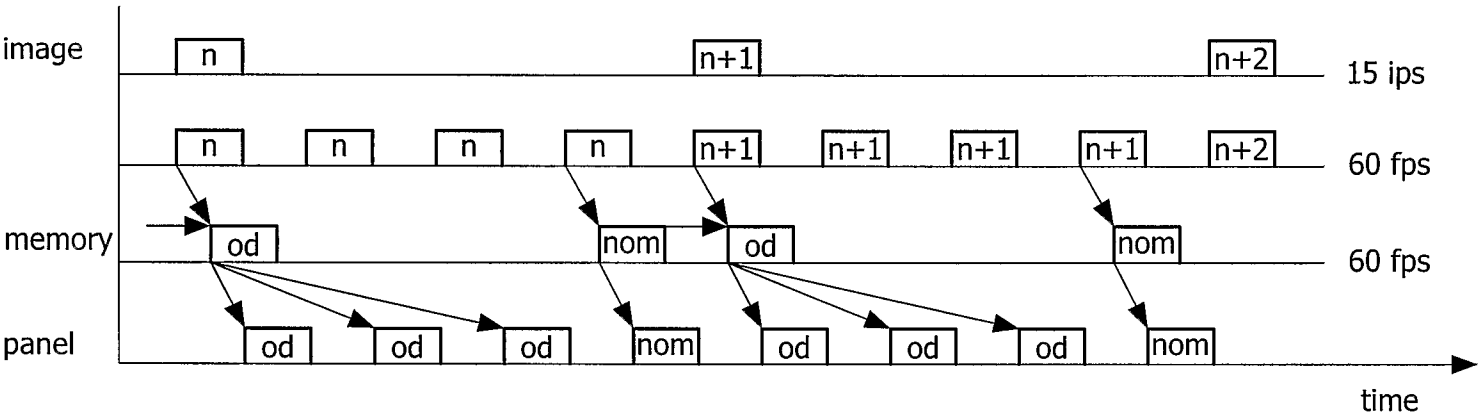

A preferred way of performing overdrive on image data having a low image rate is illustrated in FIG. 4*c*. The image data is frame rate up-converted, where the initial input image is transferred just before the next input image, and stored in the embedded frame memory, without being processed. This uncorrected frame acts as a reference for the overdrive correction of the first frame of the next image. Overdrive is calculated on the first frame and the overdrive corrected image in the embedded frame memory 330 is repeated multiple times (frames) to the panel. The last frame of the four frames corresponding to an image is a nominal frame, which is written to the embedded frame memory 330 and sent to the LCD panel 340 without overdrive correction.

Figure 4D:
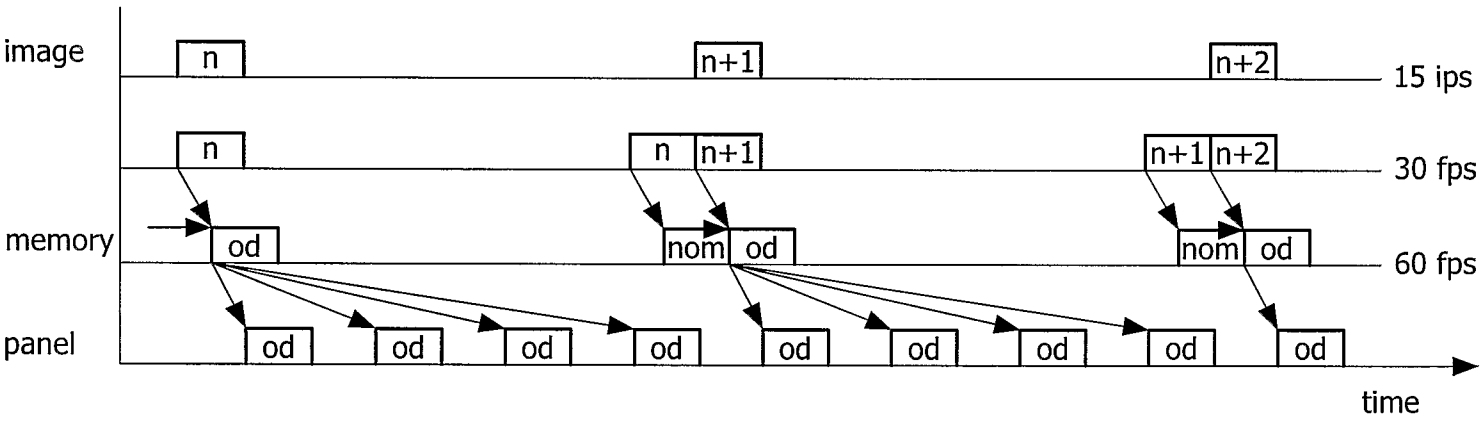

A further preferred way to perform overdrive is shown in FIG. 4*d*. Frame rate up-conversion for the image data is fully done inside the driver, using the overdrive corrected image data in the embedded frame memory 330. Nominal image data of the previous image is used to end overdrive the current image and calculate the overdrive of the next frame before being displayed on the LCD panel. After writing the fourth frame, nominal image data is written to the embedded frame memory 330. Immediately thereafter, image data 'n+1' is supplied to the overdrive block 305 to be overdrive corrected before begin displayed on the LCD panel 340.

Figure 5:
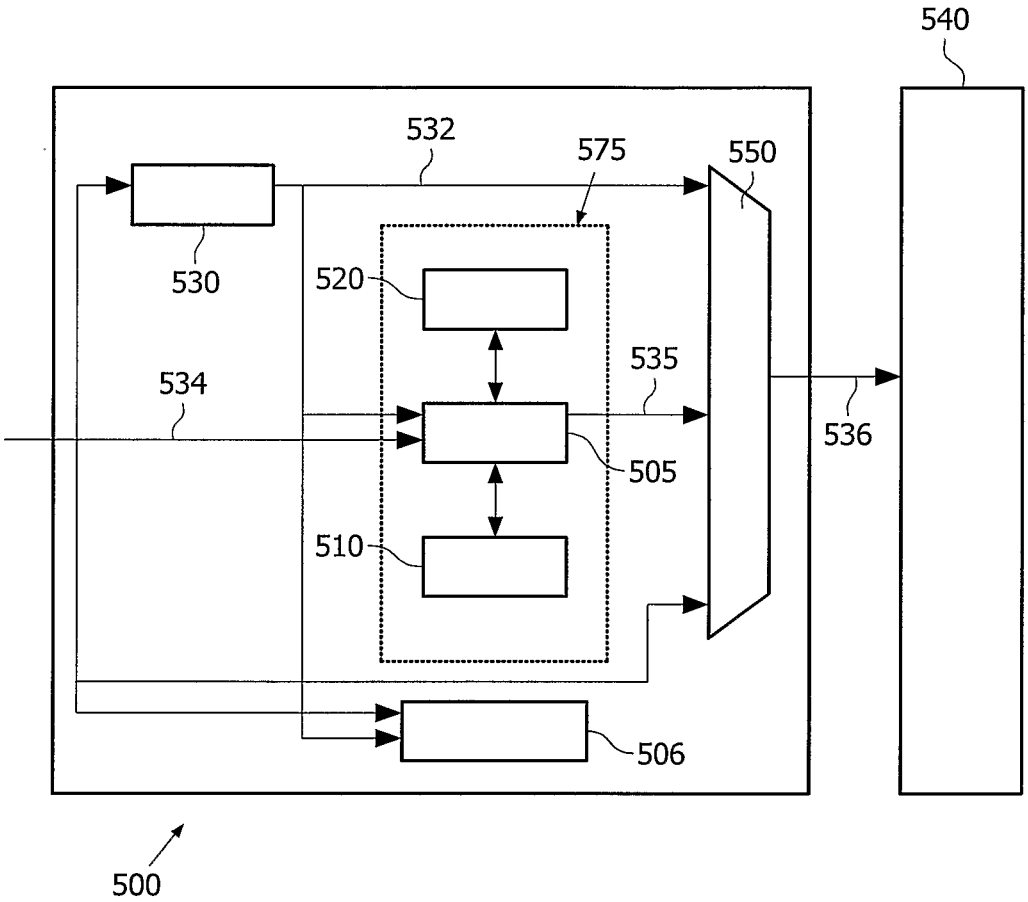
FIG. 5 schematically shows an embodiment of the display driver also suitable for operating in the direct display mode in accordance with the invention, and FIGS. 6*a*-6*d* schematically show different direct display operational modes. It should be noted that the above-mentioned embodiments illustrate rather than limit the invention and that those skilled in the art will be able to design alternative embodiments without departing from the scope of the appended claims. In the claims, any reference signs should not limit the scope of the claim. The invention can be implemented by means of hardware comprising several distinct elements.

An additional embodiment of the display driver according to the invention is shown in FIG. 5. The display driver 500 comprises a overdrive logic block 505, a overdrive lookup table 510 and control logic block 520, a overlay unit 506, a mixer 550 and a LCD display panel 540. This driver comprises a few additional components so as to support further operational modes. The units may be combined into a single block 575 but does not in any way restrict them in being individual units. The display drive in addition comprises a overlay block 506 that is used especially when the incoming display data comprising the images are transmitted to the panel in the overlay mode. It also comprises a mixer 550 to mix different display data signals, for example a static menu overlay with background video images. This embodiment supports different modes as will be discussed in the figure description that follows.

In the direct display mode, or the external timing mode as it is also referred to as hereinafter, the image data can be directly written to the LCD panel 540 without being stored in the embedded frame memory 530.

Figure 6A:
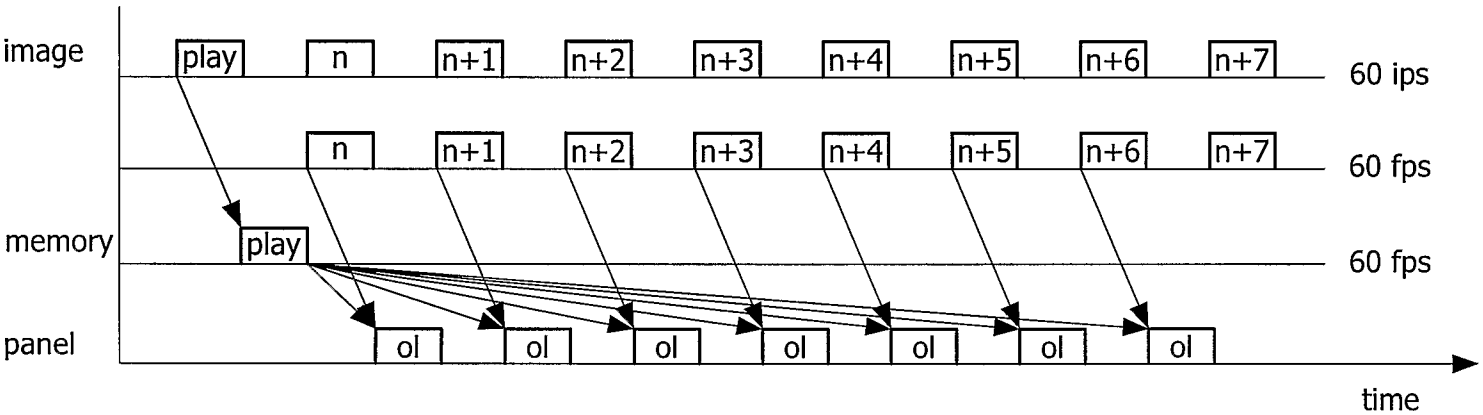

FIG. 6*a* illustrates an external timing operational mode of the driver called the overlay mode. In the overlay mode an overlay image is stored in the embedded frame memory 530, in the Figure represented as 'olay'. The overlay image enters the overlay block 506 and is stored in the embedded frame memory 530. New background image data 'n', 'n+1', etc are mixed with the 'olay' image data from the embedded frame memory 530 in the mixer 550 before being displayed on the LCD panel 540. This mix of the incoming image data with the overlay data from the embedded frame memory 530 is represented on the LCD panel 540 as 'ol' as indicated in the Figure. In the overlay mode, for example a static menu is displayed as an overlay in combination with moving images as background. The moving image data comes in as display data 534 and is displayed on the LCD panel 540 via the mixer 550. The menu image is fetched from the embedded frame memory 530 and mixed in the mixer 550 with the background image data signal. The mixed image signal 'ol' is then displayed on the LCD panel 540. In the overlay mode the embedded frame memory 530 is already occupied and there is no overdrive correction. This is not a problem as the overlay data is by definition a static image.

Figure 6B:
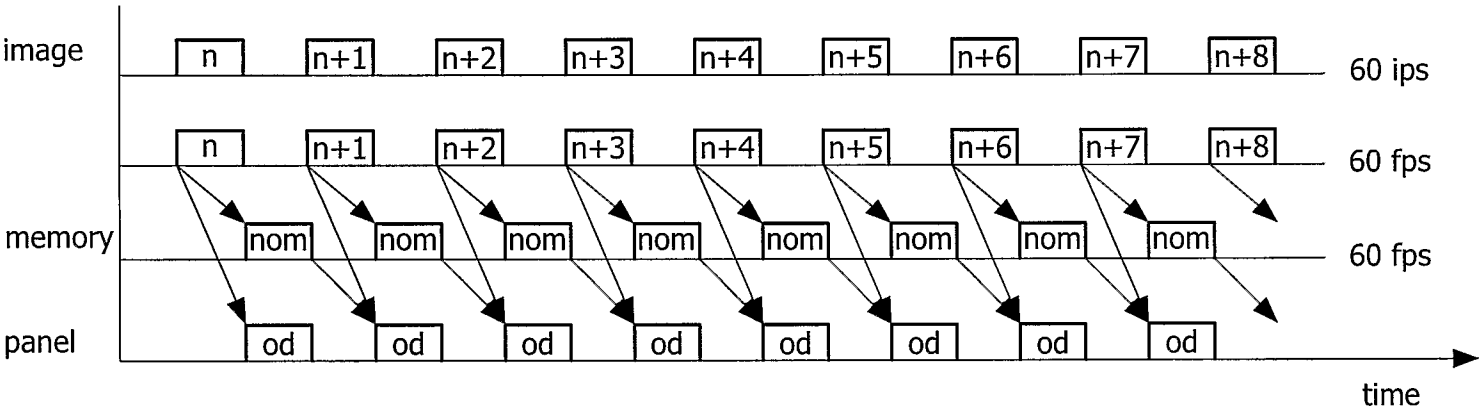

FIG. 6*b* schematically shows the application of overdrive to an incoming video signal before it is displayed on the LCD panel 540. The incoming video signal is stored in the embedded frame memory 530 for overdrive correcting the next image of the video data. The embedded frame memory 530 thus acts as a FIFO for storing previous image data. The overdrive corrected data "od" is directly displayed on the LCD panel 540 as the mixer 550 is inactive in this mode.

Figure 6C:
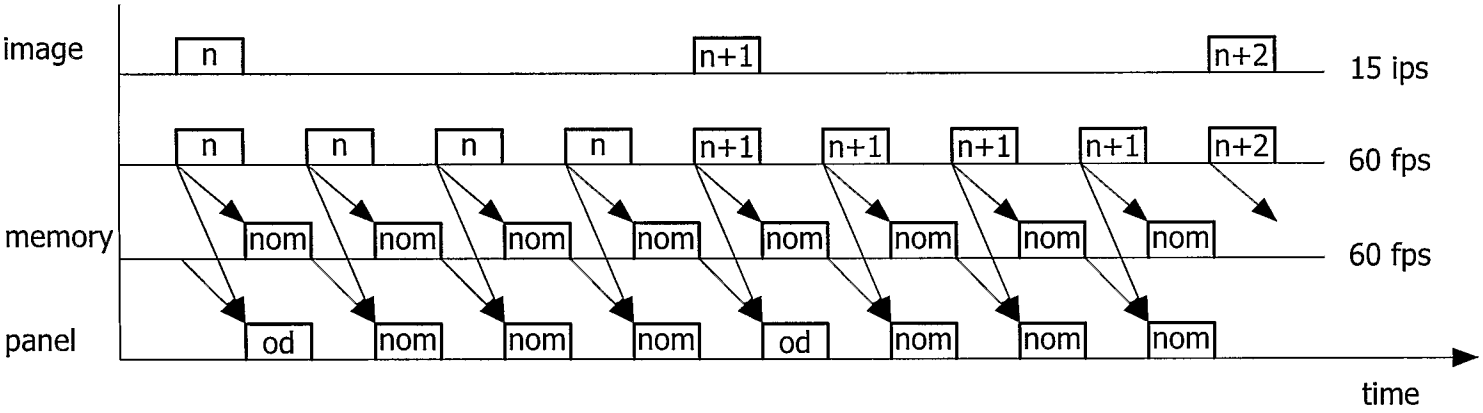

In FIG. 6*c* the image rate is at 15 images per second. Each image is sent multiple times to enhance the incoming display data to 60 frames per second in the time domain. Once again the embedded frame memory 530 acts as a FIFO for storing previous frame data. The overdrive corrected data 'od' is sent to the LCD panel 540. The first frame of each image data 'n', 'n+1' etc is overdrive corrected using the last nominal frame of 'n−1', 'n', etc stored in the embedded frame memory 530. The image data for the next three frames of the same image data 'n', 'n+1' etc are not overdrive corrected as, again, $V''_{(pixel_n)}=V_2+C_f*(V_{(pixel_n)}-V''_{(pixel_n)})=V_2+C_f*(0)=V_{(pixel_n)}$. Therefore, the first frame of each image is overdrive corrected and the next three nominal frames are effectively not overdrive corrected as is clear from the above.

Figure 6D:
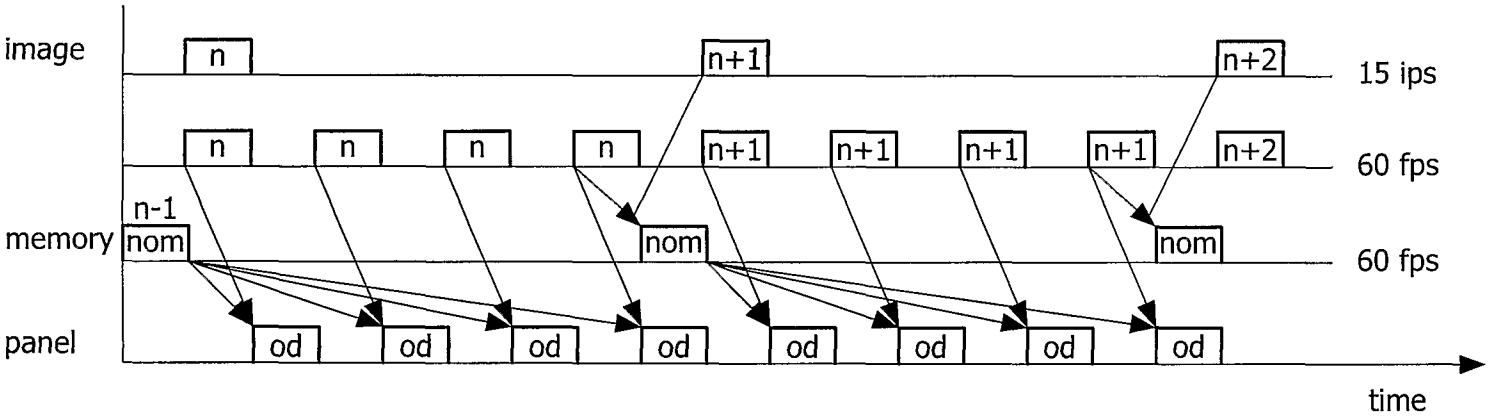

FIG. 6*d* also shows the same input image at a low incoming rate of 15 images. Each incoming image is sent multiple times so that the incoming display data is at 60 frames per second. The last frame of an image is not only sent to the LCD panel 540 but is also stored in the embedded frame memory 530 and is used to overdrive correct the incoming image data 'od' before it is displayed on the LCD panel 540 as indicated in the Figure. In this case all frames are overdrive corrected before they are displayed on the LCD panel 540.

Any of the modes described in the above can also be used in combination, that is, for a part of the image the driver operates in a given mode, and for a different part of the image the driver operates in another mode. For example, the driver can be set to operate in a direct display mode with overdrive for a video windows, and simultaneously operate in the frame rate up-conversion mode for a static background image.

The new overdrive schemes as described herein, can be applied effectively to the LCD display devices that are driven by the display driver having an embedded frame memory, as is the general case in applications related to smaller LCD display devices such as mobile phones, PDA's and so on. This technique of overdrive correction of the incoming display data signal to improve motion portrayal by efficient power consumption is a cost effective solution for this high volume electronic market segment.

Although the invention has been elucidated with reference to the embodiments described above, it will be evident that other embodiments may be alternatively used to achieve the same object. The scope of the invention is therefore not limited to the embodiments described above but can be applied to display drivers for larger LCD for example in TV's and so on.

It should be further noted that use of the verb "comprising/comprises" and its conjugates in this specification, including the claims, is understood to specify the presence of stated features, integers, steps or components, but does not exclude the presence or addition of one or more other features, integers, steps, components or groups thereof. It should also be noted that the indefinite article "a" or "an" preceding an element in a claim does not exclude the presence of a plurality of such elements. Moreover, any reference sign does not limit the scope of the claims; the invention can be implemented by means of both hardware and software, and the same item of hardware may represent several "means". Furthermore, the invention resides in each and every novel feature or combination of features.

This invention relates to a display driver comprising an embedded frame memory and an overdrive logic block, for moderating display data of a current frame received by the display driver by means of overdrive. The overdrive logic block is arranged for reading data from and writing data to the embedded frame memory and for using display data of a previous frame stored in the embedded frame memory for calculating overdrive display data of the current frame. The overdrive display data can be used for refreshing the image depicted on a display device. The invention further relates to an LCD display device comprising such a display device. Further, by overdriving the pixel drive voltage in alternating frames improves the response characteristics of the transmission of the pixel. Another further embodiment of the invention is to switch between the direct display mode and the internal timing mode where the embedded frame memory acts as a FIFO in the direct display mode.

The invention claimed is:

1. A method of providing lower power consumption for a display driver, the method comprising:

storing display data of a previous frame in an embedded frame memory, wherein video windows are refreshed for every frame while the embedded frame memory stores a static overlay;

arranging an overdrive logic block for reading the display data from and writing the display data to the embedded frame memory;

using, in the overdrive logic block, the stored display data of the previous frame, display data of a current frame, and overdrive correction factors stored in an overdrive lookup table to calculate an overdrive correction for the current frame; and using the calculated overdrive correction to provide overdrive compensation for the display data of the current frame in the display driver.

2. The method of claim 1, further comprising:

calculating the overdrive correction for odd frames and not for even frames.

3. The method of claim 1, further comprising:

calculating the overdrive correction based on only part of a display area representing a video window.

4. The method of claim 1, further comprising:

storing the overdrive correction in the embedded frame memory for at least part of the current frame.

5. The method of claim 1, further comprising:

arranging the embedded frame memory as a frame store for repeating the display data in a frame rate up-conversion mode.

6. The method of claim 1, further comprising:

arranging the embedded frame memory as a frame delay First In First Out (FIFO) buffer in a direct display mode.

7. The method of claim 1, further comprising:

storing an overlay image in the embedded frame memory in an overlay mode.

8. A method of providing lower power consumption for a display driver, the method comprising:

storing display data of a previous frame in an embedded frame memory, wherein video windows are refreshed for every frame while the embedded frame memory stores a static part;

arranging an overdrive logic block for reading the display data from and writing the display data to the embedded frame memory;

using, in the overdrive logic block, the stored display data of the previous frame and the display data of the current frame to calculate an overdrive correction for the current frame;

using the calculated overdrive correction to provide overdrive compensation for the display data of the current frame in the display driver;

storing overdrive correction factors in an overdrive lookup table; and using the stored overdrive correction factors to calculate the overdrive correction.

9. A display driver having lower power consumption, the display driver comprising:

an embedded frame memory that stores display data of a previous frame, wherein video windows are refreshed for every frame while the embedded frame memory stores a static overlay;

an overdrive logic block that reads the display data from and writes the display data to the embedded frame memory, calculates an overdrive correction for the current frame using the stored display data of the previous frame, display data of a current frame, and overdrive correction factors stored in an overdrive lookup table, and uses the calculated overdrive correction to provide overdrive compensation for the display data of the current frame in the display driver.

10. The display driver of claim 9, wherein the display driver provides the overdrive correction for odd frames and not for even frames.

11. The display driver of claim 9, wherein the display driver provides the overdrive correction for a first frame of each image and not for subsequent frames.

12. The display driver of claim 9, further comprising:

an overlay block that receives an overlay image.

13. The display driver of claim 12, further comprising:

a mixer that combines the overlay image with a background image to produce a mixed image.

14. The display driver of claim 13, further comprising:

a Liquid Crystal Display (LCD) panel that displays the mixed image.

15. The display driver of claim 12, wherein the overlay image is a static image.

16. The display driver of claim 9, wherein the display driver simultaneously operates in a direct display mode for video windows and a frame rate up-conversion mode for a static background image.

* * * * *